United States Patent [19]

Moulin

[11] Patent Number: 4,572,070

[45] Date of Patent: Feb. 25, 1986

[54] NEEDLE-CARRYING HEAD FOR A PRINTING MACHINE

[75] Inventor: Blaise Moulin, Corcelles, Switzerland

[73] Assignee: Caracteres S.A., Neuchatel, Switzerland

[21] Appl. No.: 621,661

[22] Filed: Jun. 18, 1984

[30] Foreign Application Priority Data

Jun. 24, 1983 [CH] Switzerland ..... 3460/83

[51] Int. Cl.[4] ..... B41J 3/12

[52] U.S. Cl. ..... 101/93.05; 335/268; 400/124

[58] Field of Search ..... 400/124; 101/93.05; 335/267, 268

[56] References Cited

U.S. PATENT DOCUMENTS 3,217,640 11/1965 Bradshaw ..... 101/93.05
3,822,005 7/1974 Murat ..... 400/124
4,408,907 10/1983 Bernardis ..... 400/124

FOREIGN PATENT DOCUMENTS 9853 1/1980 Japan ..... 101/93.05

OTHER PUBLICATIONS

Lisinski; IBM Tech. Disc. Bull., vol. 23, No. 1, Jun. 1980; pp. 44 and 45.
Habich; IBM Tech. Disc. Bul., vol. 25, No. 5, Oct. 1982; p. 2658.

*Primary Examiner*—Clyde I. Coughenour
*Attorney, Agent, or Firm*—Silverman, Cass & Singer, Ltd.

[57] ABSTRACT

A needle-carrying head for a printing machine has needles which are short and rectilinear, the distance separating them being greater than the distance which must separate the printed points produced in the printing operation. Hence, the needles do not have to be bent to enable electro-magnets which drive them to act thereon. The needle-carrying head is mounted in the printing machine in such a way that the plane of the needles is inclined with respect to the writing direction, which compensates for the effect of the distance separating the needles and permits, by appropriate choice of the said inclination, an overlapping of the printed points.

4 Claims, 3 Drawing Figures

NEEDLE-CARRYING HEAD FOR A PRINTING MACHINE

BACKGROUND OF THE INVENTION (a) Field of the Invention

This invention relates to a needle-carrying head for a printing machine.

(b) Description of the Prior Art

In known printing machines using needles, in which the needles are operated by means of electromagnets in such a way that their front ends strike an inking ribbon and thus produce individual printed points on the printing support, a bank of the needles is situated in a plane perpendicular to the writing direction, that is to say parallel to the direction of the needle spacing.

Each printed character is thus made up of a succession of points, and not of continuous lines. It is accordingly necessary, in order that the writing be legible on the one hand and so that its appearance be aesthetically acceptable on the other hand, that the printed points are of very small diameter (not greater than the width of the lines for which they are substituted) and, especially, that their definition be very high, that is to say that they are very close to each other.

This double condition gives rise to very difficult problems relating to the construction of the machine. As a matter of fact, if nine needles of a diameter of about some hundredths of millimeters (30/100 millimeter, for instance) must be juxtaposed within the height of a character, of 3 mm for instance, the distance separating the needles will be slightly more than 3/100 millimeter. Now, it is impossible to juxtapose mechanical means for driving needles in so small a distance. This necessitates, in the known needle-carrying heads, that the needles are bent so that their rear ends are considerably more widely spaced (for instance 4 mm) than their front ends.

This arrangement results in a construction which is relatively complicated, needles which are relatively long and, by reason of their deflection, to the need for a precise guiding of the needles which, however, does not prevent the risk of buckling being increased. Finally, the length of the needles, determined by their deflection and which is relatively important, results in the fact that the mass of the needles is not negligable and this restricts the striking speed.

SUMMARY OF THE INVENTION

The object of the present invention is to overcome the foregoing drawbacks.

This object is achieved due to the fact that a needle-carrying head for a printing machine according to the invention is characterized by the fact that it comprises a bank of rectilinear needles the distance between which is greater than the allowable distance which may separate the printed points, these needles being arranged in a plane intended to be inclined with respect to the writing direction, the distance between the printed points measured in the direction of the spacing thereof being determined by the slope of said plane on the one hand and by the distance separating the needles from each other on the other hand.

The various features of the invention will be apparent from the following description, drawings and claims, the scope of the invention not being limited to the drawings themselves as the drawings are only for the purpose of illustrating ways in which the principles of the invention can be applied. Other embodiment of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
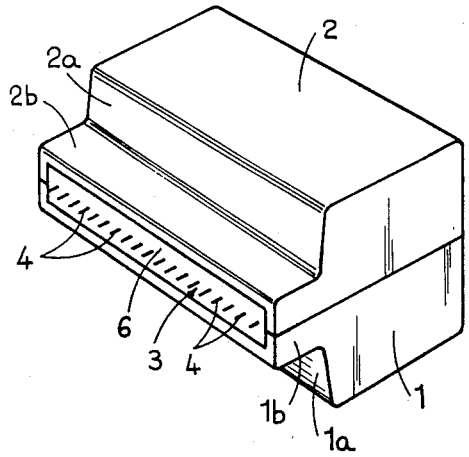
FIG. 1 is a perspective view of a needle-carrying head for a printing machine.
Figure 2:
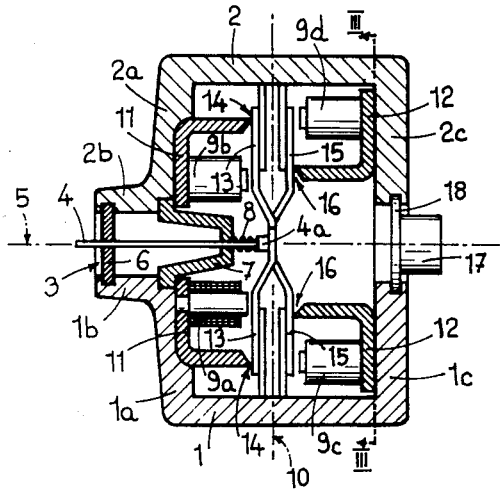
FIG. 2 is a sectional view of the head, perpendicular to the longitudinal axis thereof and to a larger scale.
Figure 3:
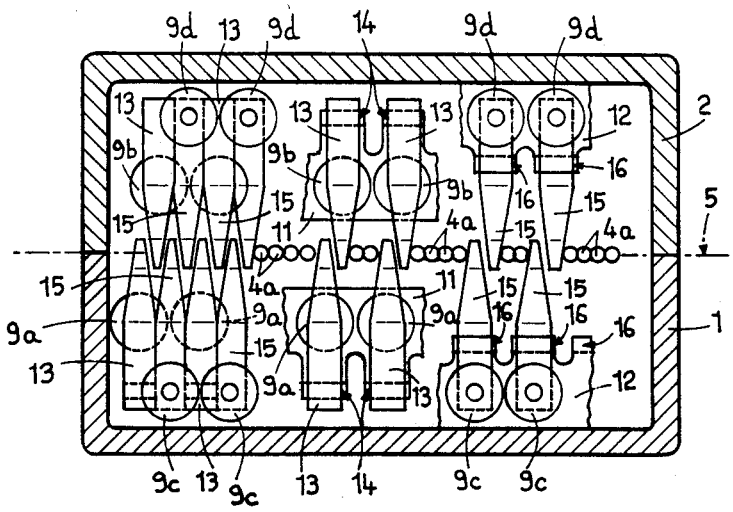
FIG. 3 is a sectional view of the said head on the line III—III of FIG. 2 in which a portion of the elements which are visible in the said sectional view has been eliminated to increase the clearness of the drawing.

The needle-carrying head illustrated comprises a casing of generally parallelepiped shape made of two elements 1 and 2 connected to each other by means which are not shown. The front face 1*a*, respectively 2*a*, of each of these elements 1 and 2 of the casing is provided with a raised edge 1*b*, respectively 2*b*, extending upright, these edges providing between them a narrow elongated rectangular window 3 through which pass the front ends of the printing needles designated by reference 4. These needles constitute a bank thereof located in a plane indicated at 5 in FIGS. 2 and 3.

The number of the needles in this specific case is 32 and the distance separating two immediately adjacent needles is 1.8 mm with the diameter of each needle being 0.27 mm.

The needles 4 are mounted in such a way as to be slidable axially in two guiding members 6 and 7 carried by the portions 1*b* and 2*b* of the elements 1 and 2 of the casing. Each needle is provided, at its rear end, with a head 4*a* serving as an abutment for one end of a helical return spring 8 mounted on the needle and which bears, at its other end, on the member 7.

The axial displacements of the needles are controlled by electro-magnets 9*a*, 9*b*, 9*c* and 9*d* distributed in four groups of eight electro-magnets each. The electro-magnets 9*a* and 9*b* are situated in front of a plane, designated by reference 10 in FIG. 2, which is perpendicular to the needles and passes through the rear face of all the heads 4*a* of the latter, while the electro-magnets 9*c* and 9*d* are situated behind this plane. The electro-magnets 9*a* and 9*c* are situated below the plane 5 of the needles 4 while the electro-magnets 9*b* and 9*d* are situated above this plane.

Two angle brackets 11 serving to support the whole electro-magnets 9*a* and 9*b* are carried by the front part of the element 1 of the casing while two angle brackets 12 serving to support the electro-magnets 9*c* and 9*d* are carried by the rear part, designated 1*c* and 2*c*, respectively, of the elements 1 and 2 of the casing.

The electro-magnets 9*a* and 9*b* act on their respective needles by means of driving levers 13, bearing at 14 on the edge, which is bevelled for this purpose, of one of the limbs of the angle brackets 11. So far as the electro-magnets 9*c* and 9*d* are concerned, they act on the needles by means of levers 15 bearing at 16 on the edge, bevelled for this purpose, of one of the limbs of the angle brackets 12. The electro-magnets 9*a* and 9*b* being arranged head to foot with respect to the electro-magnets 9*c* and 9*d*, respectively, it is necessary, so that their action on the needles will be identical for the levers 13 and 15, to be of different types. Thus levers 13 are of the third order type and levers 15 of the first order type. In the case of the electro-magnets 9*a* and 9*b* of the levers 13, the electro-magnets are disposed at half the distance between the bearing point 14 of the levers and the point of application of their force on the heads 4*a* of the needles while, in the case of the electro-magnets 9*c* and 9*d* and of the levers 15, bearing points 16 are situated at one-third of the distance separating the electro-magnets from the point of application of the force on the needles. Hence, with identical electro-magnets energized by a same voltage, the force applied to the needles is the same in the two cases.

All the electro-magnets are fed by small connection plates 17 provided with plugs mounted on a small bar 18 interposed between the portions 1*c* and 2*c* of the elements 1 and 2 of the casing.

The distance separating the needles 4, at their operating front end (1.8 mm), being much greater than the allowable distance of separation of the printed points, which permits the use of rectilinear needles in spite of the space occupied by their driving means, it is necessary for the printing machine receiving the present head to be arranged in such a way that the plane 5 of the needles is inclined with respect to the writing direction or, in other words, with respect to the spacing direction which is perpendicular to the writing direction. The distance between the printed points in the spacing direction will depend on the distance separating the needles on the one hand and on the inclination of the plane 5 on the other hand, as this distance is the projection, on the spacing axis, of the ends of the needles. From this it will be appreciated that the distance of the printed points is not dependent on mechanical requirements and that the definition of the printed points can be as high as desired; it is sufficient therefore to reduce the inclination of the plane 5; the only limitation resides on the one hand in the number of the needles which is increased with the reduction of the slope of the plane 5, a number which obviously cannot be unlimited, and on the other hand in the fact that the number of strikes needed for the printing of each sign or character will increase whith the number of the needles. However, it is to be noted that the increase of the striking time due to the multiplication of the points is compensated by the fact that the needles can strike several signs or characters at the same time. Finally, another cause of compensation is that the striking speed can be increased due to the fact that the needles, which are rectilinear are shorter than the bent needles presently used and, consequently, are of lower mass. In practice, needles of 3 cm of length will be suitable. Their number is limited by the total width which must not reasonably go beyond the printing machine, taking into account the fact that the needle-carrying head must be able to move beyond the two margins—left hand and right hand sides— of the printed text so that the signs or characters can be printed right up to these margins over their whole height.

With the dimensions indicated previously, that is to say 32 needles of a diameter of 0.27 mm, one can cover the whole of the spacing which, according to the usual standards, is of 4.23 mm, with an overlapping of the printing points extending over half of their diameter. The above-mentioned data are obtained by the application of the formula $4.32\ \text{mm}=(n-1)d/2$.

It has to be pointed out that such an overlapping of the printed points is not obtainable with conventional printing heads having needles which are juxtaposed according to a line which is parallel to the direction of spacing, when no overlapping is possible even with a single row of needles. Now, an overlapping such as hereabove mentioned, according to which the printed points overlap by half their diameter, has the effect that the characters or printed patterns no more appear as being half-tone screened as is the case with points distinct from each other, but as a uniform printing with the interstices between the points not being visible. In any case, these interstices could even be eliminated by using needles having an octogonal cross section, for example.

In the example illustrated the plane 5 of the needles is parallel to the general direction of the casing 1–2 of the needle-carrying head, so that this casing is placed in an inclined position on the printing machine. This machine can, if desired, be provided with means allowing adjustment of the inclination of the needle-carrying head, which enables the appearance of the printing to be modified without changing the control program of the machine.

As a modification (which is not shown) the arrangement may be such that the plane 5 of the needles is not parallel to the general direction of the casing 1–2, utilising a construction whereby the plane of the needles is situated in a position inclined with respect to the longitudinal plane of the needles-carrying head.

I claim:

1. A needle carrying head for a printing machine which includes a bank of rectilinear needles the distance between which is greater than the allowable distance which may separate the respective printed points; the needles arranged in a common plane and having front and rear ends and electro-magnetic means driving each of the needles respectively; said electro-magnetic means constituting four groups of electro-magnets, said electro-magnetic means comprising a first group having members thereof disposed in front of a plane taken perpendicular to the needles and passing by the rear ends of the needles, a second group arranged in head to foot arrangement with respect to the members of the first group, members of the second group being arranged rearward of said perpendicular plane, selected ones of the first and second group forming a third group, members of which are disposed above a horizontal plane passing through the axes of the needles and selected ones of the first and second groups forming a fourth group, members of which are disposed below the said horizontal plane, levers of the first order and levers of the third order disposed for operation thereon by ones of said electro-magnet groups, those of the electro-magnets of said first and second groups which are arranged in front of the plane perpendicular to the needles being arranged to act on the needles through the intermediary of said levers of the third order type while the electro-magnet situated rearward of said perpendicular plane being arranged to act on the needles through the intermediary of said levers of the first order type.

2. A needle-carrying head as claimed in claim 1, in which the electro-magnets operating the levers of the third order type act thereon at a point of each of them situated at half the distance between its fulcrum and the point of application of the force on the needles, while the levers of the first order type have fulcrums at points situated at the first third of the length counted from the point of each of them at which the electro-magnets act, the arrangement being such that, by means of identical electro-magnets energized by the same voltage, all the needles are subjected to the same striking force.

3. A needle-carrying head as claimed in claim 1 in which said electro-magnets are identical and capable of being energized by the same voltage, all said needles being subject to the same striking force.

4. The needle-carrying head as claimed in claim 1 in which the head is adapted to be mounted and the distance between the printed points measured in the direction of the spacing thereof being determined by the inclination of said plane on the one hand and by the distance separating the needles from each other on the other hand.

* * * * *